US009982501B2

(12) United States Patent
Back et al.

(10) Patent No.: US 9,982,501 B2
(45) Date of Patent: May 29, 2018

(54) SAFETY LATCH FOR A DOWNHOLE TOOL

(71) Applicant: SANDVIK INTELLECTUAL PROPERTY AB, Sandviken (SE)

(72) Inventors: Goran Back, Nora (SE); Kenneth Reid, Strickland (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 253 days.

(21) Appl. No.: 14/888,087

(22) PCT Filed: Apr. 25, 2014

(86) PCT No.: PCT/EP2014/058461

§ 371 (c)(1),
(2) Date: Oct. 29, 2015

(87) PCT Pub. No.: WO2014/177468

PCT Pub. Date: Nov. 6, 2014

(65) Prior Publication Data

US 2016/0084030 A1 Mar. 24, 2016

(30) Foreign Application Priority Data

Apr. 30, 2013 (AU) ..... 2013901497

(51) Int. Cl.
*E21B 31/18* (2006.01)
*E21B 25/02* (2006.01)

(52) U.S. Cl.
CPC ..... *E21B 31/18* (2013.01); *E21B 25/02* (2013.01)

(58) Field of Classification Search
CPC ..... E21B 31/18; E21B 25/02
See application file for complete search history.

(56) References Cited

U.S. PATENT DOCUMENTS

| | | | | |
|---|---|---|---|---|
| 720,078 A | | 2/1903 | Washington et al. | |
| 1,719,144 A | | 7/1929 | Stokes et al. | |
| 2,296,397 A | | 9/1942 | Muhlbach | |
| 3,288,167 A | * | 11/1966 | Gibson | F16K 27/0209 137/541 |
| 3,441,098 A | | 4/1969 | Martinsen et al. | |

(Continued)

FOREIGN PATENT DOCUMENTS

| | | |
|---|---|---|
| WO | 2010140896 A1 | 12/2010 |
| WO | 2010145984 A2 | 12/2010 |

(Continued)

*Primary Examiner* — Taras P Bemko
*Assistant Examiner* — Brandon M Duck
(74) *Attorney, Agent, or Firm* — Corrine R. Gorski

(57) ABSTRACT

A lockable overshot assembly for use in a wireline spearhead system for lowering and retrieving inner tube assemblies and other tools and equipment from a downhole location includes a pair of lifting dogs pivotally mounted to an overshot head on the lockable overshot assembly and configured for latching a spearhead. A locking arrangement is mounted into the elongated body and engagable within the lifting dogs, such that in a locked state the lifting dogs are in latched position and in an unlocked state, allows the lifting dogs to move to the release position. The locking arrangement is a pin, which can be moved laterally to be between the latching dogs to prevent them moving to the release position.

11 Claims, 6 Drawing Sheets

(56) References Cited

U.S. PATENT DOCUMENTS

| | | | | |
|---|---|---|---|---|
| 6,296,059 | B1 * | 10/2001 | Leeb | E21B 34/14<br>137/599.01 |
| 2002/0157872 | A1 * | 10/2002 | Attwater | E21B 7/24<br>175/56 |
| 2009/0242203 | A1 | 10/2009 | Pardey | |

FOREIGN PATENT DOCUMENTS

| | | | |
|---|---|---|---|
| WO | 2012119186 | A1 | 9/2012 |
| WO | 2012129662 | A1 | 10/2012 |

* cited by examiner

SAFETY LATCH FOR A DOWNHOLE TOOL

RELATED APPLICATION DATA

This application is a § 371 National Stage Application of PCT International Application No. PCT/EP2014/058461 filed Apr. 25, 2014 claiming priority of AU Application No. 2013901497, filed Apr. 30, 2013.

FIELD OF INVENTION

The present invention relates to a lockable overshot assembly, typically, though not exclusively, for use in a wireline spearhead system for lowering and retrieving inner tube assemblies and other tools and equipment from a downhole location.

BACKGROUND ART

A typical overshot assembly comprises a tubular body in which a pair of lifting dogs is pivotally mounted. The lifting dogs pivot about a transverse axis on an axle which attaches the lifting dogs to the body. A first end of the lifting dogs is adapted for catching a spearhead point therebetween. A spring is disposed between the second opposite ends of the lifting dogs for biasing the first ends toward each other to a capture position where a spearhead point can be caught. The bias of the spring holds the first ends of the lifting dogs together about a caught spearhead point.

In order to release a captured spearhead point an operator pushes the second ends of the lifting dogs together against the bias of the spring thereby spreading the first ends of the lifting dogs and releasing the spearhead point. For safety and efficiency reasons it is critical that the lifting dogs do not accidentally or prematurely release a caught spearhead point. For example when retrieving an inner tube assembly from a hole using an overshot, serious injury or death can occur to an operator if the core barrel becomes accidentally released from the overshot while the overshot is being suspended near the top of a drill rig. Similarly, very expensive equipment can be lost downhole if it becomes detached from an overshot. There is therefore a need for an overshot that addresses these problems.

SUMMARY OF THE INVENTION

It is an objective of the present invention to provide a safety locking system for an overshot assembly or to at least provide a locking system to prevent unintentional disengagement of the overshot from an inner tube assembly or other tool or equipment used within downhole drilling locations.

The objectives are achieved, in part, by a locking arrangement provided at a head region of the overshot main body that may be manually or otherwise adjusted to lock the movable engaging members of the overshot when engaged onto a spearhead point of a component part of the downhole drilling apparatus. In particular, the locking arrangement is configured by engagement to prevent the movable engaging members from pivoting, sliding or otherwise moving from engagement about the spearhead point when in an engaged configuration.

According to a first aspect of the present invention there is provided a lockable overshot assembly for releasable connection to a spearhead point of a component part of downhole drilling apparatus, the assembly comprising an elongated body having a head; a pair of lifting dogs pivotally mounted at the head, said lifting dogs having respective first ends configured for releasable latching of a spearhead point therebetween, respective second ends opposite said first ends and said lifting dogs being pivotally mounted at the head at a pivot location axially intermediate said first and second ends, said first ends being pivotally moveable toward each other to a latched position such that the spearhead point is latched therebetween and are pivotally moveable away from each other to a release position such that the latched spearhead point is released; characterised by: a locking arrangement mounted at the head and engagable with the lifting dogs at a region axially between the respective second ends and the pivot location the locking arrangement configured such that in a locked state the lifting dogs are locked in said latched position and, in an unlocked state the lifting dogs are allowed to move to the release position.

Preferably the locking arrangement comprises a pin, movable transversely between the locked state where the pin is located between the lifting dogs to prevent pivotal movement of the second ends toward each other and the unlocked state where the pin does not prevent pivotal movement of the second ends of the lifting dogs toward each other. The pin is advantageous to provide an accessible movable member that may be manipulated between the engaged and disengaged positions via an external pressure.

Preferably the overshot further comprises detent means for releasably holding the locking arrangement selectively in the locked and unlocked states. The detent means is effective to provide a safety latching arrangement to reliably maintain the locking arrangement in the locked and unlocked states. The detent means may also be considered advantageous for attachment of the sensors or other components to enable operators to identify the present locking arrangement is operational in the locked and unlocked states.

In an alternative embodiment the locking arrangement comprises a bore extending transverse through the head and positioned axially between the respective second ends and the pivot location and a pin received in the transverse bore, the pin being movable transversely between the locked state where the pin is between the lifting dogs and prevents pivotal movement of the second ends of the lifting dogs toward each other and the unlocked state where the pin does not prevent pivotal movement of the second ends of the lifting dogs toward each other. The bore and pin arrangement provide a lightweight mechanism for the reliable locking of the lifting dogs in the various pivoted positions.

Preferably the pin comprises a first cylindrical portion of a first diameter and a second cylindrical portion of a second diameter less than the first diameter and a stepped portion between the first cylindrical portion and the second cylindrical portion wherein when the first cylindrical portion is engaged between the lifting dogs the pin prevents pivotal movement of the second ends of the lifting dogs toward each other and when the second cylindrical portion is between the lifting dogs the pin does not prevent pivotal movement of the second ends of the lifting dogs toward each other. The relative positioning of the pivot location of the lifting dogs and the locking arrangement ensures that the lifting dogs are free to engage onto the spearhead point whilst providing the option to lock the dogs in position at the spearhead points.

Preferably the head further comprises a detent arrangement selectively engaging the pin for releasably holding the locking arrangement selectively in the locked and unlocked states.

Preferably the pin is manually movable between the locked and unlocked states against the detent arrangement. Preferably, the pin is accessible at either end of the laterally extending bore so as to be movable laterally through the bore via the application of finger pressure or via the use of a tool.

Preferably the pin comprises a flange having first and second shoulders, wherein the detent arrangement is configured to engage the first shoulder on a first side of the flange when the locking arrangement is in the locked state and to engage the second shoulder on the second side of the flange when the locking arrangement is in the unlocked state. The shoulder configuration of the pin is advantageous such that the pin provides a dual function dependent upon its position within the bore to firstly allow pivoting action of the lifting dogs and secondly to lock and prevent pivoting action of the lifting dogs.

Preferably the detent arrangement includes a biased locking ball extending from an outer surface of said head, the ball engaging the first shoulder on the first side of the flange when the locking arrangement is in the locked state and the ball engaging the second shoulder on the second side of the flange when the locking arrangement is in the unlocked state. The biases locking bore arrangement is beneficial to provide a resiliently biased obstruction between the different positions of the locking arrangement. A tactile means of confirming the state of the locking arrangement is accordingly provided.

Preferably the detent arrangement includes a biased locking ball extending from an outer surface of said head and first and second recesses are formed in the pin for partially receiving said locking ball, said first recess being disposed to register with said locking ball the pin is in said locked state and said second recess is disposed to register with said locking ball when the pin is in said unlocked state.

Alternatively the overshot further comprises means for positively moving the pin between the locked and unlocked states. Such means may be manual, automated or semi-automated so as to be controllable remotely from the surface when the overshot is located in use down-the-hole.

Preferably the means for positively moving the pin between the locked and unlocked states comprises a part helical track on an outer cylindrical surface of the pin and a tooth at the head engaged into the part helical track whereby rotation of the pin with respect to the head causes transverse movement of the pin between the locked and unlocked states.

Preferably the pin comprises a transverse slot in an end surface capable of being engaged by a driving tool to thereby rotate the pin and causing the transverse movement of the pin between the locked and unlocked states. The driving tool may be a screwdriver or an automated or semi-automated device for imparting rotation to the pin. The pin and bore accordingly may be threaded having respective radially outward facing and radially inward facing threads.

Preferably, the transverse bore extends completely through the head such that respective end surfaces of the pin are exposed at respective ends of the bore such that pressure is capable of being applied to either of said surfaces to move the pin within the bore between the locked and unlocked states.

According to a second aspect of the present invention there is provided drilling apparatus comprising an overshot assembly as claimed herein.

BRIEF DESCRIPTION OF DRAWINGS

A specific implementation of the present invention will now be described, by way of example only, and with reference to the accompanying drawings in which.

DETAILED DESCRIPTION OF PREFERRED EMBODIMENT OF THE INVENTION

Figure 1:
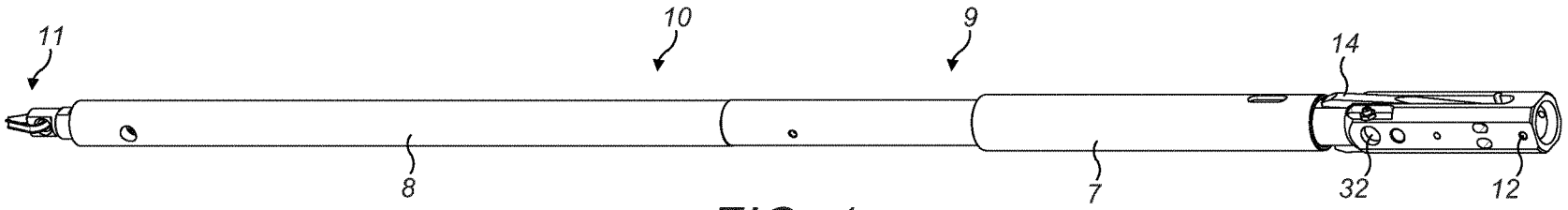
FIG. 1 shows an embodiment of a lockable overshot assembly according to the present invention.
Figure 2A:
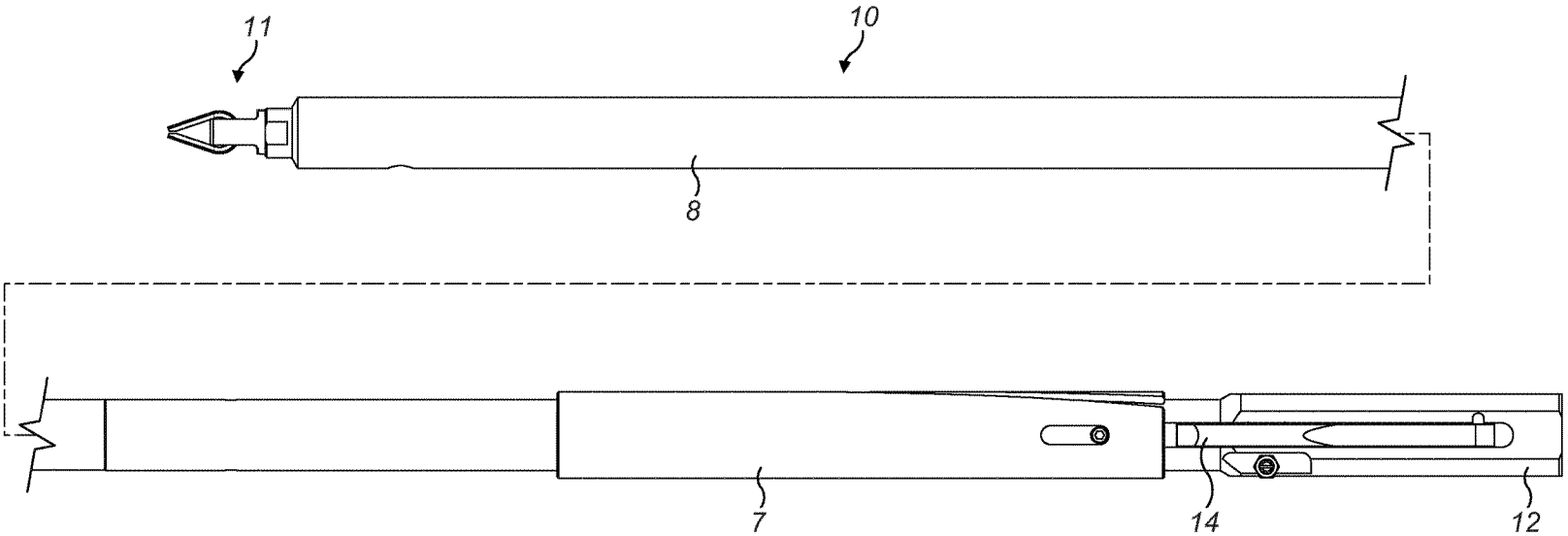
FIG. 2A shows a more detailed view of the embodiment of a lockable overshot assembly of FIG. 1.
Figure 2B:
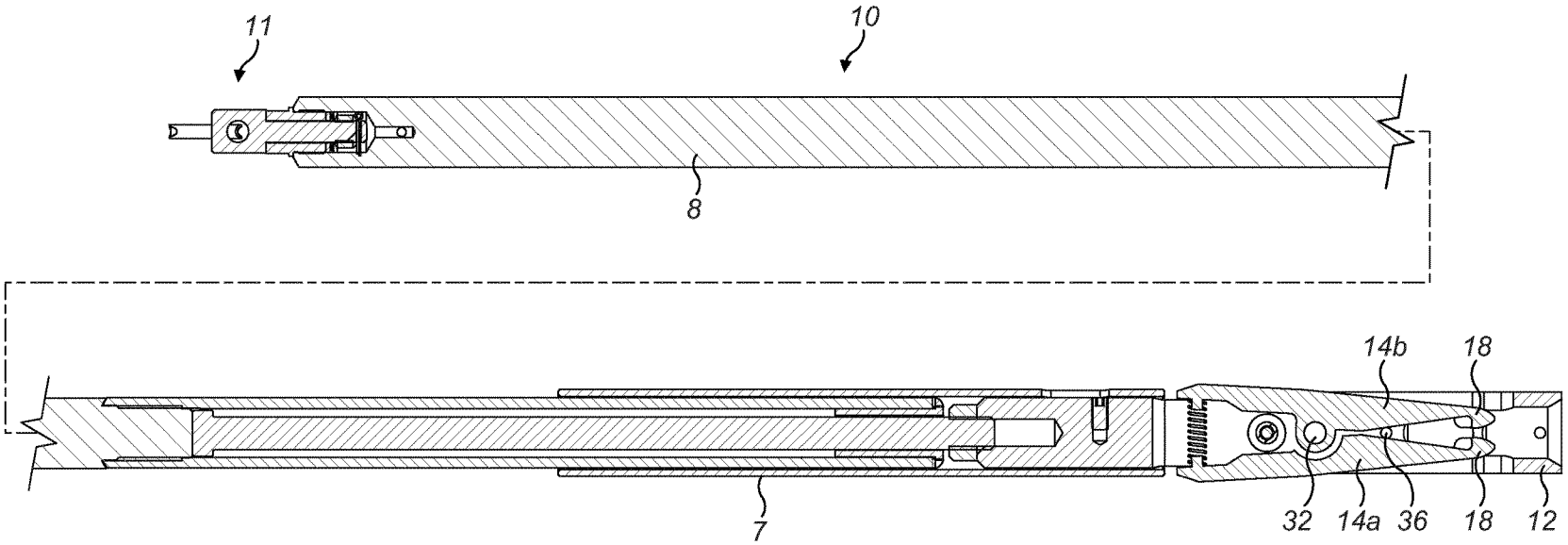
FIG. 2B show as longitudinal cross section of the lockable overshot assembly shown in FIG. 2A.

Referring to FIGS. 1, 2A and 2B of the accompanying drawings, the lockable overshot 10 includes an elongated swivel body 8 and a overshot assembly 9. The overshot assembly 9 comprises a jar tube 7 and an overshot head 12. The overshot head 12 has lifting dogs 14*a* and 14*b* (hereinafter referred to in general as "lifting dogs 14") mounted within it. The lifting dogs 14 are pivotally mounted to the overshot head 12 and are provided with respective first ends 18 configured for latching a spearhead point therebetween. To this end, the lifting dogs 14 are of a substantially conventional configuration in which each first end 18 is provided with a hook-like formation which catches beneath a spearhead point (not shown). The upper end 11 of the lockable overshot 10 has an eyelet for attaching a cable and wire rope thimble for lowering and lifting the lockable overshot through a drill string.

Looking at the components of the lockable overshot assembly 9 in more detail as shown in FIGS. 3A to 3C and 4A to 4C, it can be seen that the overshot head 12 includes a hollow tubular lower portion 20 to which the lifting dogs 14 are pivotally mounted. An elongated transversely extending slot 24 is formed through the body 12. The slot 24 provides room for the lifting dogs 14 to pivot as well as facilitating the assembly of the lifting dogs 14 into the body 12.

Extending radially through the lower portion 20 transverse to the slot 24 is a hole 30 for receiving a pivot pin 32 which pivotally mounts the lifting dogs 14 to the overshot head 12. In this regard, the pivot pin 32 passes through respective eyelets formed intermediate the length of each of the lifting dogs 14. A second smaller diameter hole 36 is formed through the overshot head 12 parallel to the hole 30 on the side opposite the upper portion 22. The hole 36 seats a spring pin (not shown) which is disposed between the lifting dogs 14*a* and 14*b* and acts to limit the degree by which the first ends 18 can pivot toward each other. When the lifting dogs 14 are in the latched position, they both bear on opposite sides of the spring pin.

Figure 4A:
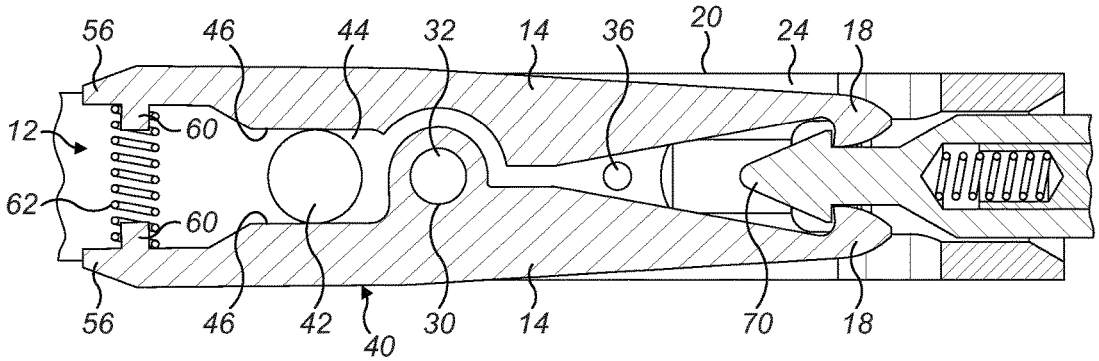
FIGS. 4A to 4C show various views of the lifting dog portion of the lockable overshot assembly of FIG. 1 in a position to safely retain and engaged spearhead point.
Figure 4B:
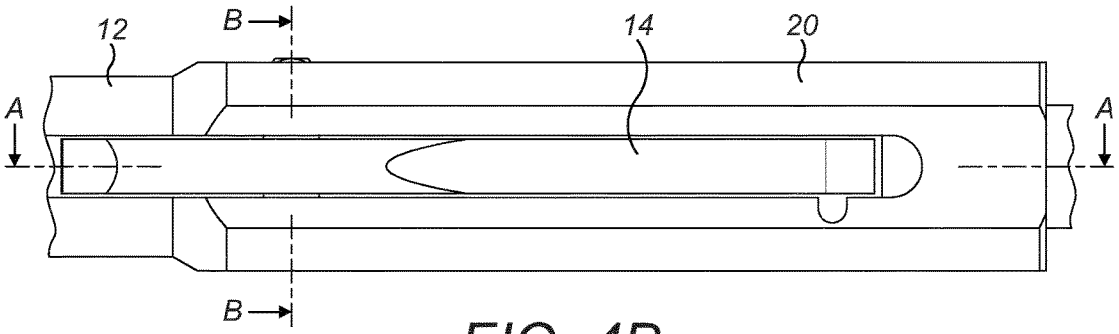

The lifting dogs have second ends 56 and inwardly directed locating pins 60 are provided at the second ends 56 for seating opposite ends of a compression string 62. The compression spring 62 is configured to bias the latching dogs 14 so that the ends 18 are biased towards a capture position as shown in FIG. 4*a*.

A locking arrangement generally shown as 40 is mounted into a transverse bore 44 (see FIGS. 3C and 4C) in the elongated body and engageable with the inner surface 46 of the lifting dogs 14 between the respective second ends 56 and the intermediate pivoting axle 32 so that the locking arrangement in a locked state locks the lifting dogs in said latched position and, in an unlocked state allows said lifting dogs to move to the release position.

The locking arrangement in this embodiment comprises a pin 42 with the pin being manually movable transversely in the bore 44 between the locked state where the pin 42 is between the lifting dogs 14 and engages the inner surfaces 46 and prevents pivotal movement of the lifting dogs toward each other between the respective second ends and the intermediate location and the unlocked state where the pin 14 is moved laterally and does not engage the inner surfaces 46 and does not prevent pivotal movement of the lifting dogs 14 toward each other between the respective second ends and the intermediate location.

Figure 6:
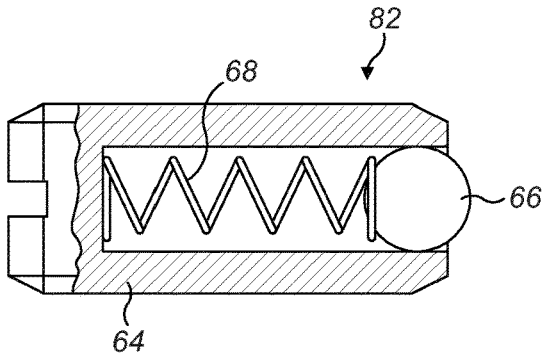
FIG. 6 shows a detent arrangement according to the present invention.

A detent arrangement 48 (as shown in detail in FIG. 6) engages with a flange 49 which is part of the pin assembly as will be discussed in more detail below. The detent arrangement 48 comprises a housing 64 with a ball 66 and spring 68 received within it. The spring urges the ball away from the housing. When the ball of the detent arrangement engages with a shoulder 49*a* on one side of the flange the pin 42 is retained in the disengaged or unlocked position and when the detent arrangement engages with an opposite shoulder 49*b* on the other side of the flange the pin 42 is retained in the engaged or locked position.

Figure 3A:
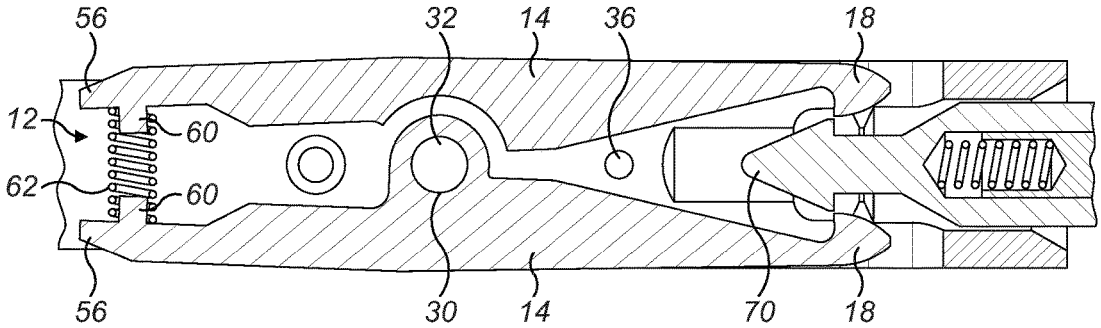
FIGS. 3A to 3C show various views of one embodiment of the lifting dog portion of the lockable overshot assembly of FIG. 1 in a position to engage a spearhead point.
Figure 3B:
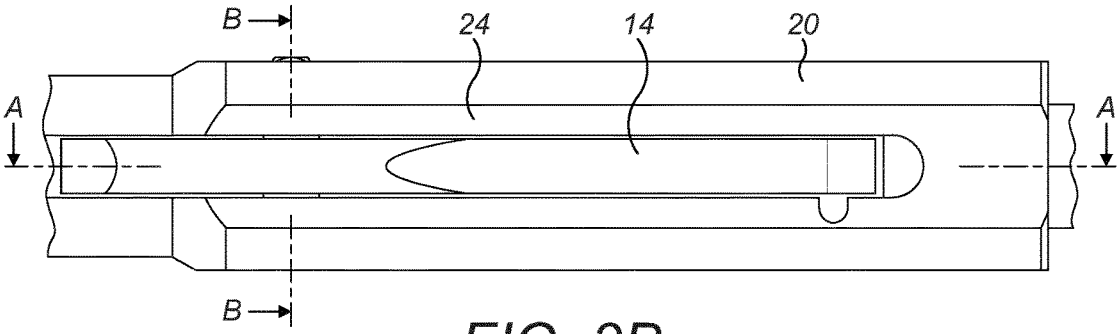
Figure 3C:
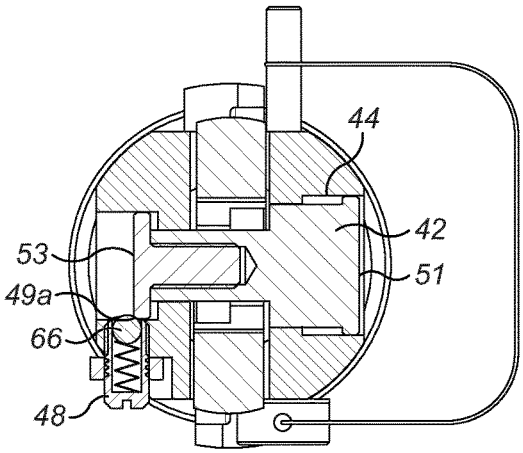
Figure 4C:
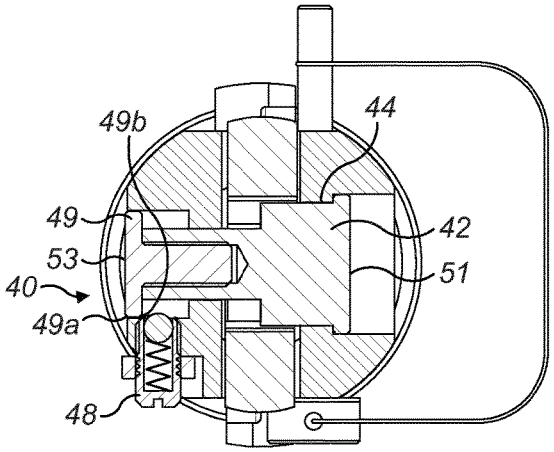

Manual pressure on the end surface 51 of the pin 42 against the spring pressure of the ball 66 pushes the pin to the engaged position as shown in FIG. 4C and the hook like formations on the end of the lifting dogs 14 are engaged with the spear point 70 and cannot be released from the spear point. Manual pressure on the end surface 53 of the pin 42 pushes the pin to the disengaged position as shown in FIG. 3C and the hook like formations on the end of the lifting dogs 14 are disengaged with the spear point 70 and can be released from the spear point.

Figure 5A:
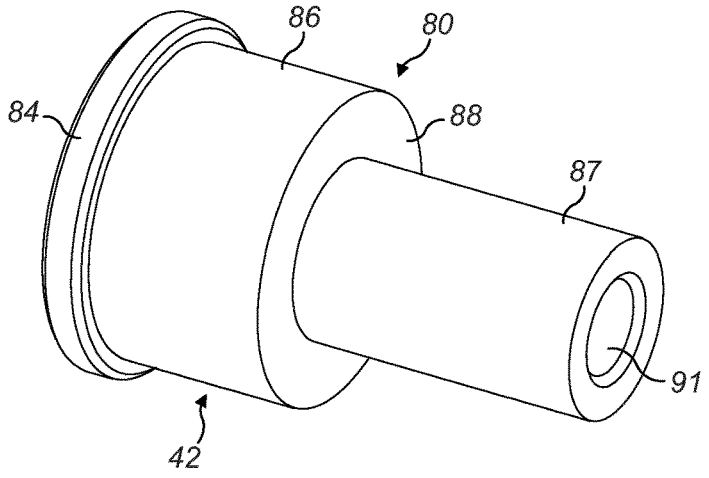
FIGS. 5A and 5B show detail of one embodiment of the pin of the of the lockable overshot assembly.
Figure 5B:
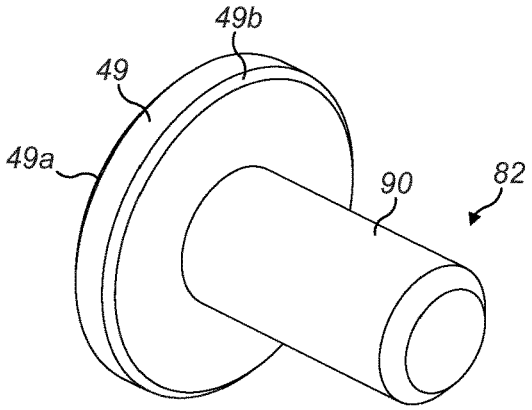

One embodiment of the pin 42 is a two part assembly as shown in FIGS. 5A and 5B. A first part 80 has a head 84, and cylindrical body 86 of a slightly smaller diameter than the head and a smaller diameter part 87 with a stepped shoulder 88 between the cylindrical body 86 and the smaller diameter part 87. A second part 82 of the pin assembly 42 has a flange 49 and a shaft 90. The smaller diameter part 87 of the first part has a through bore 91 into which is received the shaft of the second part of the pin assembly. The flange 49 has a shoulders 49*a* and 49*b* as discussed above. The first part of the pin 80 and the second part of the pin 82 are joined together when assembled into the lockable overshot by fastening means such as a threaded screw (not shown).

Figure 7A:
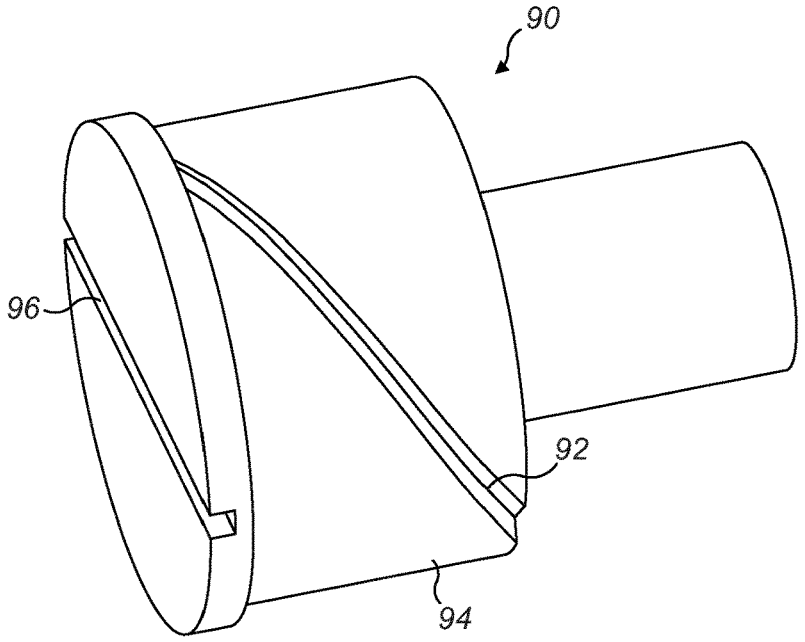
FIGS. 7A and 7B show various views of an alternative embodiment of a pin of the of the lockable overshot assembly.
Figure 7B:
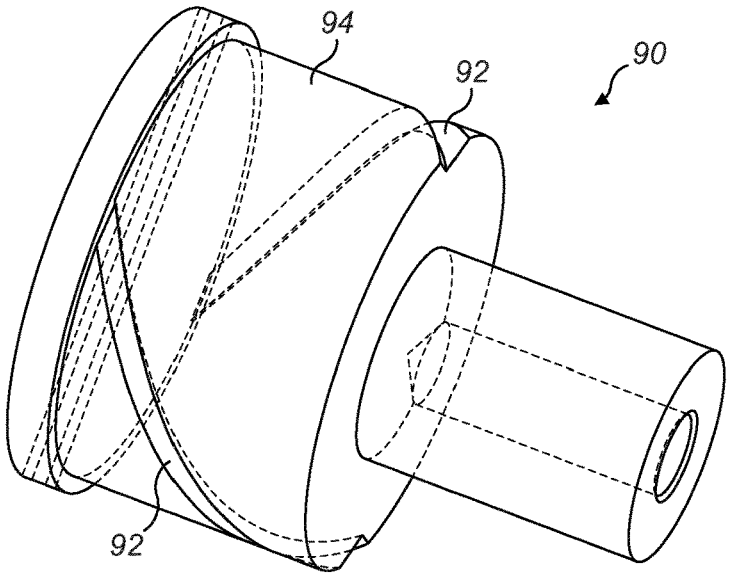

An alternative embodiment of pin is shown in FIGS. 7A and 7B. In this embodiment the pin 90 includes means for positively moving the pin between the locked and unlocked states. The means for positively moving the pin between the locked and unlocked states comprises a part helical track 92 on an outer cylindrical surface 94 of the pin and a tooth (not shown) on an inner cylindrical surface of the bore 44 (see FIG. 4C) in the elongated body with the tooth engaged into the part helical track whereby rotation of the pin with respect to the elongated body causes transverse movement of the pin between the locked and unlocked states. The pin 90 comprises a transverse slot 96 in an end surface and the transverse slot can be engaged by a driving tool such as a screw driver to thereby rotate the pin and thereby causing transverse movement of the pin between the locked and unlocked states.

As shown in FIG. 7B there can be a pair of part helical tracks 92 on opposite sides of the outer cylindrical surface 94 of the pin.

The invention claimed is:

1. A lockable overshot assembly for releasable connection to a spearhead point of a component part of downhole drilling apparatus, the assembly comprising:

an elongated body having a head;

a pair of lifting dogs pivotally mounted at the head, said lifting dogs having respective first ends configured for releasable latching of the spearhead point therebetween and respective second ends opposite said first ends, said lifting dogs being pivotally mounted at the head at a pivot location axially intermediate said first and second ends, said first ends being pivotally moveable toward each other to a latched position such that the spearhead point is latched therebetween and are pivotally moveable away from each other to a release position such that the latched spearhead point is released; and a locking arrangement mounted at the head and engagable with the lifting dogs at a region axially between the respective second ends and the pivot location, the locking arrangement being configured such that in a locked state the lifting dogs are locked in said latched position and in an unlocked state the lifting dogs are allowed to move to the release position, wherein the locking arrangement includes a bore extending transverse through the head and positioned axially between the respective second ends and the pivot location and a pin received in the bore, the pin being movable transversely between the locked state where the pin is between the lifting dogs and prevents pivotal movement of the second ends of the lifting dogs toward each other and the unlocked state where the pin does not prevent pivotal movement of the second ends of the lifting dogs toward each other, and wherein the head includes a detent arrangement that selectively engages the pin for releasably holding the locking arrangement selectively in the locked and unlocked states, the pin being movable between the locked and unlocked states against the detent arrangement, wherein the pin includes a flange having first and second shoulders, wherein the detent arrangement is configured to engage the first shoulder on a first side of the flange when the locking arrangement is in the locked state and to engage the shoulder on a second side of the flange when the locking arrangement is in the unlocked state.

2. The overshot assembly as claimed in claim 1, wherein the locking arrangement includes a pin movable transversely between the locked state where the pin is located between the lifting dogs to prevent pivotal movement of the second ends toward each other and the unlocked state where the pin does not prevent pivotal movement of the second ends of the lifting dogs toward each other.

3. The overshot assembly as claimed in claim 2, further comprising means for positively moving the pin between the locked and unlocked states.

4. The overshot assembly as claimed in claim 3, wherein the means for positively moving the pin between the locked and unlocked states includes a part helical track on an outer cylindrical surface of the pin, whereby rotation of the pin with respect to the head causes transverse movement of the pin between the locked and unlocked states.

5. The overshot assembly as claimed in claim 4, wherein the pin includes a transverse slot in an end surface capable of being engaged by a driving tool to thereby rotate the pin and cause the transverse movement of the pin between the locked and unlocked states.

6. The overshot assembly as claimed in claim 1, further comprising a detent arrangement arranged to releasably hold the locking arrangement selectively in the locked and unlocked states.

7. The overshot assembly as claimed in claim 1, wherein the pin includes a first cylindrical portion of a first diameter and a second cylindrical portion of a second diameter less than the first diameter and a stepped portion between the first cylindrical portion and the second cylindrical portion, wherein when the first cylindrical portion is engaged between the lifting dogs the pin prevents pivotal movement of the second ends of the lifting dogs toward each other and when the second cylindrical portion is between the lifting dogs the pin does not prevent pivotal movement of the second ends of the lifting dogs toward each other.

8. The overshot assembly as claimed in claim 7, wherein the transverse bore extends completely through the head such that respective end surfaces of the pin are exposed at respective ends of the bore such that a pressure is capable of being applied to either of said surfaces to move the pin within the bore between the locked and unlocked states.

9. The overshot assembly as claimed in claim 1, wherein the detent arrangement includes a biased locking ball extending from an outer surface of said head, the ball engaging the first shoulder on the first side of the flange when the locking arrangement is in the locked state and the ball engaging the second shoulder on the second side of the flange when the locking arrangement is in the unlocked state.

10. The overshot assembly as claimed in claim 1, wherein said detent arrangement includes a biased locking ball extending from an outer surface of said head and first and second recesses are formed in the pin for partially receiving said locking ball, said first recess being disposed to register with said locking ball when the pin is in said locked state and said second recess is disposed to register with said locking ball when the pin is in said unlocked state.

11. A drilling apparatus comprising:

a spearhead point; and an overshot assembly releasably connected to the spearhead point, the assembly comprising an elongated body having a head, a pair of lifting dogs pivotally mounted at the head, said lifting dogs having respective first ends configured for releasable latching of the spearhead point therebetween and respective second ends opposite said first ends, said lifting dogs being pivotally mounted at the head at a pivot location axially intermediate said first and second ends, said first ends being pivotally moveable toward each other to a latched position such that the spearhead point is latched therebetween and are pivotally moveable away from each other to a release position such that the latched spearhead point is released; and a locking arrangement mounted at the head and engagable with the lifting dogs at a region axially between the respective second ends and the pivot location, the locking arrangement being configured such that in a locked state the lifting dogs are locked in said latched position and in an unlocked state the lifting dogs are allowed to move to the release position, wherein the locking arrangement includes a bore extending transverse through the head and positioned axially between the respective second ends and the pivot location and a pin received in the bore, the pin being movable transversely between the locked state where the pin is between the lifting dogs and prevents pivotal movement of the second ends of the lifting dogs toward each other and the unlocked state where the pin does not prevent pivotal movement of the second ends of the lifting dogs toward each other, and wherein the head includes a detent arrangement that selectively engages the pin for releasably holding the locking arrangement selectively in the locked and unlocked states, the pin being movable between the locked and unlocked states against the detent arrangement, wherein the pin includes a flange having first and second shoulders, wherein the detent arrangement is configured to engage the first shoulder on a first side of the flange when the locking arrangement is in the locked state and to engage the shoulder on a second side of the flange when the locking arrangement is in the unlocked state.

* * * * *